US006338360B2

(12) United States Patent
Spear et al.

(10) Patent No.: US 6,338,360 B2
(45) Date of Patent: Jan. 15, 2002

(54) HOSE REEL CARRIER ASSEMBLY

(75) Inventors: Kenneth J. Spear, Vienna, WV (US); Steven F. Brooker, Marietta, OH (US)

(73) Assignee: Ames True Temper Inc., Camp Hill, PA (US)

( * ) Notice: Subject to any disclaimer, the term of this patent is extended or adjusted under 35 U.S.C. 154(b) by 0 days.

(21) Appl. No.: 09/832,845

(22) Filed: Apr. 12, 2001

Related U.S. Application Data

(60) Provisional application No. 60/202,881, filed on May 10, 2000.

(51) Int. Cl.[7] ..... A62C 35/00

(52) U.S. Cl. ..... 137/355.22; 137/355.12; 137/355.16; 137/355.17; 137/355.19; 137/355.2; 242/395; 242/397.3

(58) Field of Search ..... 137/355.12, 355.16, 137/355.17, 355.19, 355.2, 355.22; 242/395, 397.3

(56) References Cited

U.S. PATENT DOCUMENTS

| | | | | | |
|---|---|---|---|---|---|
| 2,301,208 | A | | 11/1942 | Gear | 242/390.8 |
| 2,606,067 | A | | 8/1952 | Roark | 137/355.17 |
| 3,232,555 | A | | 1/1966 | Gorrell et al. | 242/390.8 |
| 4,513,772 | A | * | 4/1985 | Fisher | 137/355.22 |
| 4,540,017 | A | * | 9/1985 | Prange | 137/355.12 |
| 4,616,791 | A | | 10/1986 | Harvey | 242/390.6 |
| 4,777,976 | A | | 10/1988 | Johnston et al. | 137/355.27 |
| 5,758,685 | A | * | 6/1998 | Tisbo et al. | 137/355.27 |
| 5,988,552 | A | | 11/1999 | Tisbo et al. | 137/355.26 |
| 6,050,290 | A | * | 4/2000 | Yacobi et al. | 137/355.2 |

* cited by examiner

*Primary Examiner*—A. Michael Chambers
*Assistant Examiner*—Thomas L. McShane
(74) *Attorney, Agent, or Firm*—Pillsbury Winthrop LLP

(57) ABSTRACT

A hose reel carrier includes a wheeled structure having spaced apart side walls and a top wall covering a receptacle; a hose reel is rotatably mounted between the side walls and is rotated by a hand crank operated outside one of the side walls; a reciprocating hose guide carried on support rods is also driven by the crank; a fluid connection is provided through the other side wall to supply fluid to a hose carried on the reel.

78 Claims, 7 Drawing Sheets

HOSE REEL CARRIER ASSEMBLY

The present application claims priority to U.S. Provisional Application of Spear et al., Application No. 60/202,881, filed May 10, 2000.

FIELD OF INVENTION

This invention relates to protective storage devices for flexible hoses particularly of the lawn and garden watering type. More specifically, the present invention relates to a housing that provides protection for a hose reel with the hose wrapped on the reel for storage and which is also capable of supporting and storing gardening tools as well. In addition, the device of the present invention will greatly facilitate wrapping the hose on the reel and will allow connection to a source of water under pressure without requiring disconnection of the inlet end of the hose wrapped on the reel in the housing.

BACKGROUND OF THE INVENTION

The prior art has proposed a number of different structures for storing a garden hose when not in use. The structures have generally included a reel about which the hose is wrapped for storage. In some of these devices, the hose reel has been rotatable about its axis to facilitate the wrapping and unwrapping of the hose for use. In general, the hose must be completely removed from the reel to enable connection to a source of water. While for relatively short lines of hose, these devices have been useful, for any significant increase in the hose length, these devices have not been satisfactory in view of the difficulty of manipulating the hose relative to the reel when moving between the stored and extended positions of the hose. Generally, manufacturers have avoided the use of complicated gear systems and drive mechanisms for the reel in view of the expense involved. Also, since these types of carrier structures have tended to be exposed to the weather or at least placed in storage conditions for a long period of time, the useful life of such drive mechanisms tends to be unacceptably short. In addition, manufacturers have avoided complications in manufacturing in order to keep the cost of these devices as low as possible.

In many communities, outside storage of a hose is not permitted for a number of reasons including aesthetic considerations, safety and the likelihood of theft. Even where a residential occupant utilizes a reel for storage, moving the wrapped reel out of sight tends to be infrequent where the hose is connected to the water supply. Also, presently available reels generally lack any facility for supporting gardening tools for ease-of-use. With many types of different hose materials, it is important to protect the hose during storage from exposure to direct sunlight to prevent deterioration of the material of the hose where the hose is manufactured with certain inexpensive plastics such as vinyl or woven nylon yet many reel type devices have no shielding for the hose.

SUMMARY OF THE INVENTION

The present invention provides a hose reel carrier assembly which can be easily moved over the ground for use and operated to wrap the hose easily and which will allow easy extension of a length of hose relative to the reel without requiring connection of the length of hose directly to a water source. Instead, the carrier assembly itself is provided with an auxiliary hose length and a conduit system for connection to a water source while the end of the hose length carried on the reel has one end connected to an outlet carried by the reel. When it is desired to store the carrier assembly with the hose wrapped on the reel, the carrier assembly which is provided with wheels can be easily moved back to a storage position such as in a garage or shed. A number of compartments can be provided on the carrier assembly which also serve to shield the hose when wrapped on the reel from exposure to the elements and sunlight and provide storage of garden tools and the like.

In one embodiment, a reciprocating guide is provided that is linked to a manual drive for the reel so that when the reel is rotated by a user, the reciprocating guide will move back and forth across the reel to uniformly and smoothly wrap the hose on the reel to provide a compact storage configuration. Additionally, the carrier assembly includes a fluid joint that allows rotation of the outlet end of the joint with rotation of the reel thus greatly simplifying handling of the hose length. Operation of the reel is also greatly facilitated by an externally accessible handle, the rotary motion of which is linked to the hose guide for synchronous operation.

The foregoing as well as other advantages will become apparent as consideration is given to the following description and accompanying drawings, in which:

DETAILED DESCRIPTION OF THE INVENTION

Figure 1:
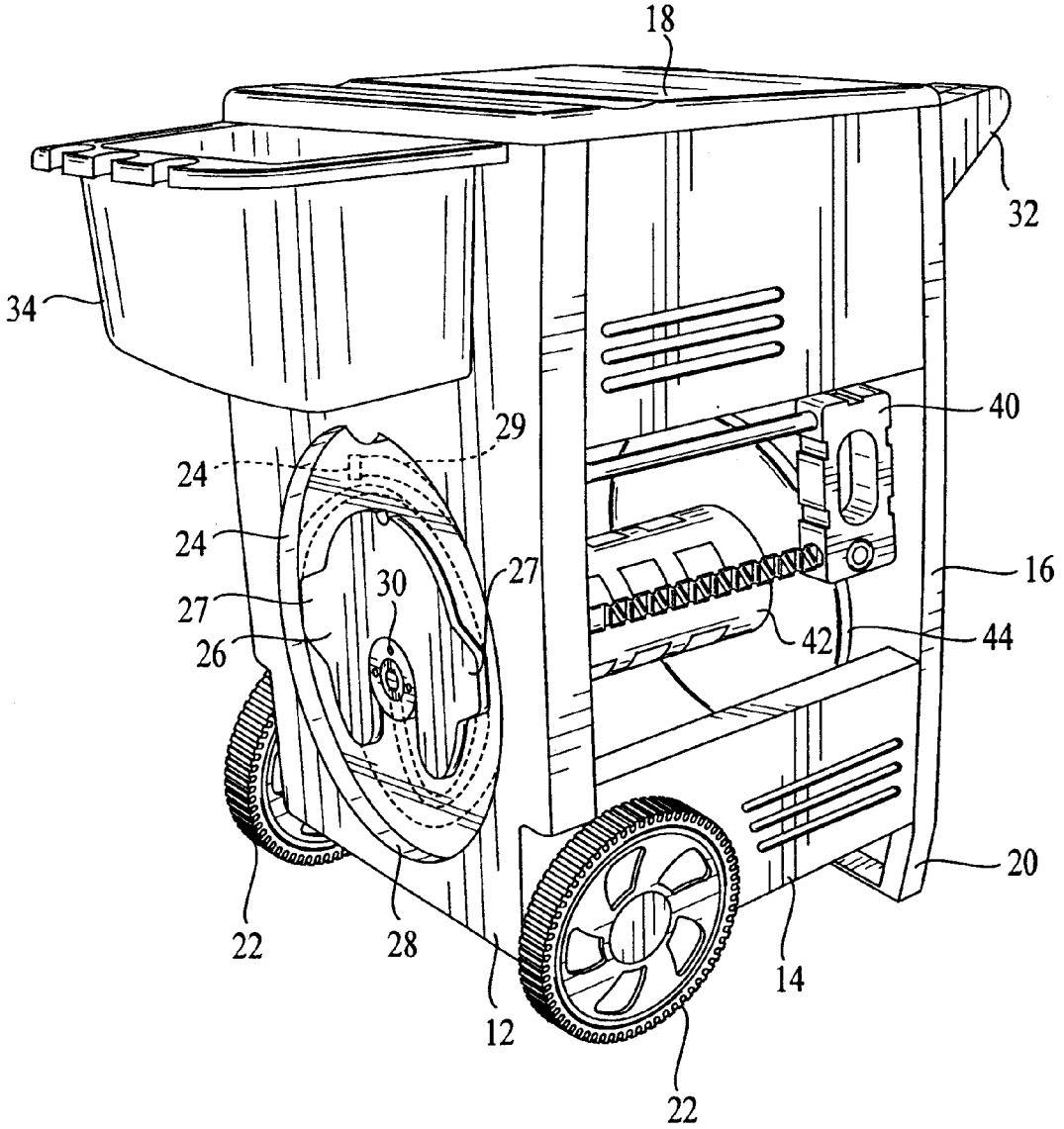
FIG. 1 is a perspective view of the hose reel carrier assembly of this invention.
Figure 2:
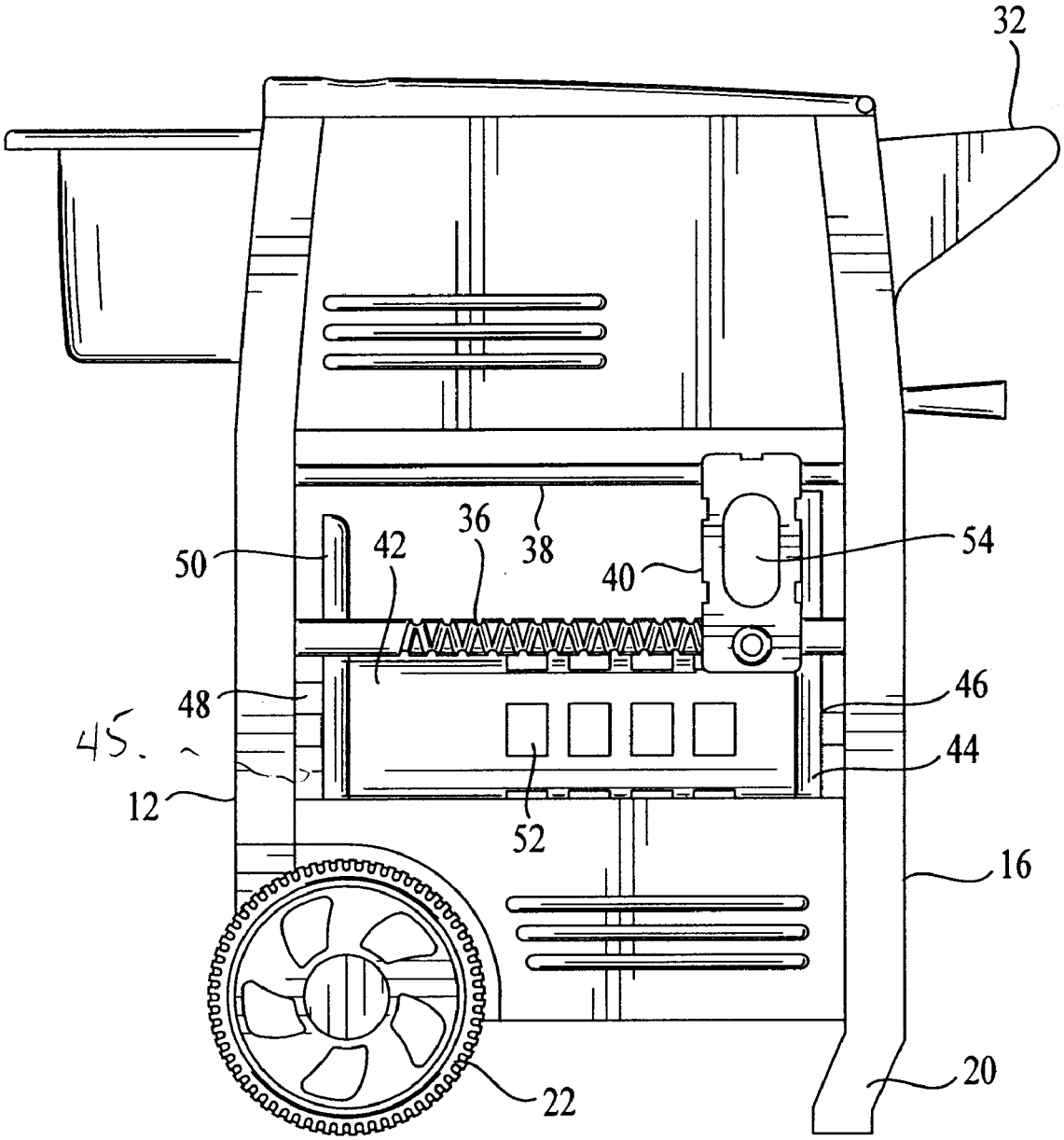
FIG. 2 a side view in elevation.

Referring to the drawings, wherein like numerals designate corresponding parts throughout the several views, there is shown in FIG. 1 the carriage assembly 10 of the present invention. In this embodiment, the carrier assembly 10 includes a front wall 12, two side walls one which is shown at 14, a rear wall 16 and the top wall or lid 18 which may be removable to gain access to a storage area underlying the lid 18.

To facilitate use and movement of the assembly 10, the rear wall 16 may be formed with depending feet or legs 20 while adjacent the front wall 12, wheels 22 are rotatably mounted on either a common or separate axles, not shown. The front wall 12 is preferably provided with a storage recess 24 which is provided with a projecting post 26 having an extended width and wings 27 to support and retain a length of auxiliary hose wrapped about the post 26. The auxiliary hose 29 has an end 30 for attachment to a water spigot while the other end is connected to a conduit system connected to the main hose which will be wrapped on an interiorly located reel 42.

The reel 42 is connected to larger diameter wheels 44 and 50 at each end. The connection may be accomplished in a number of ways such as by epoxy adhesive, interlocking fingers or screws. The wheels 44 and 50 have hubs 45 and 53, respectively, each of which is mounted on an axle, 46 and 48, respectively. The axles 46 and 48 extend concentrically relative to the axis of rotation of the reel 42 which is preferably hollow.

Figure 6:
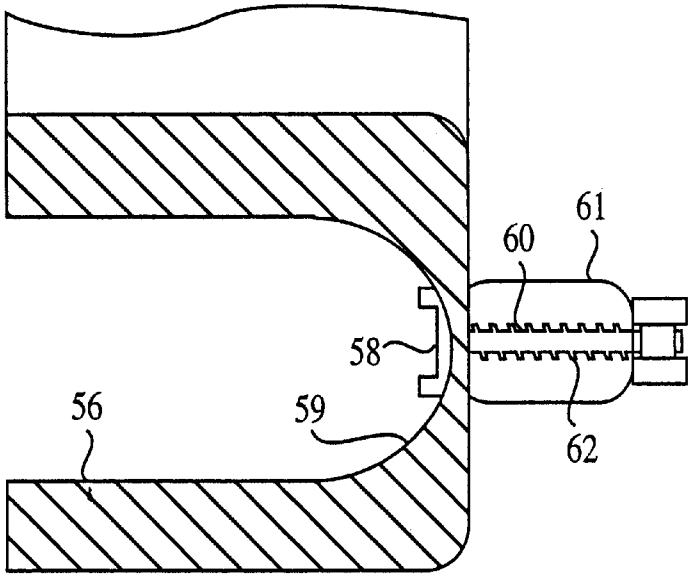
FIG. 6 is a sectional view taken along lines 6—6 of FIG. 5.
Figure 5:
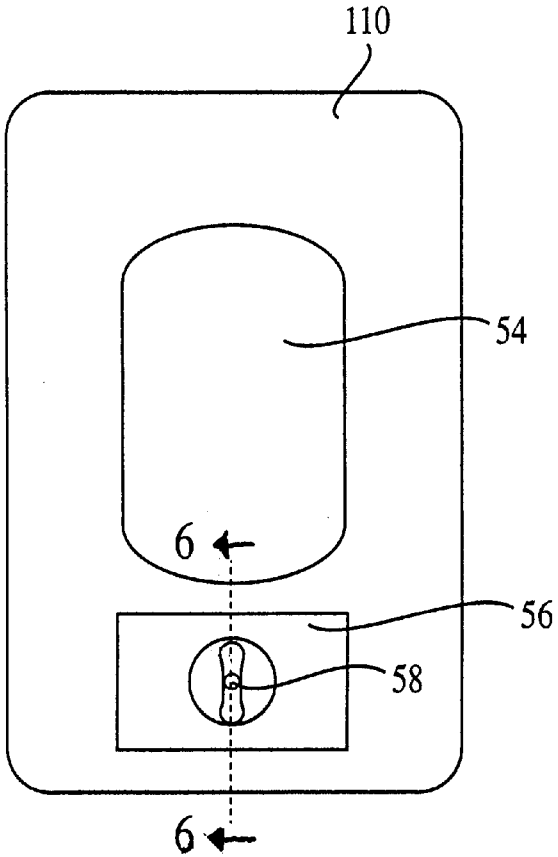
FIG. 5 is a front view in elevation of the hose guide.

Support rods 36 and 38 are mounted one above the other and spaced slightly inwardly of the outer edges of front and rear walls 12 and 16 as shown more clearly in FIG. 1. Mounted astride the rods 36 and 38 is a hose guide member 40 which includes a large central opening 54 through which a hose will be positioned in use. As shown more clearly in FIG. 5, the lower opening of the hose guide 40 is provided with a recess 56 on which is mounted a reversing lug 58 which projects outwardly from the inner wall 59 as shown more clearly in FIG. 6. The lug 58 has a shaft 60 positioned in a bore formed through the base of the recess 56 and through an extension 61 and which is surrounded by a spring 62 to resiliently hold the lug 58 in the position shown. With this arrangement, rotation of the lug 58 and shaft 60 will easily be effected when the hose guide 40 reaches one end of its travel on the guide rods 36 and 38. The ends of the lug 58 will ride slidingly in spiral grooves two sets of which are formed in the lower rod 36. The lower rod is rotated by a chain driven by the crank 64 in a selected direction. One set of grooves will effect translation of the guide 40 in one direction while the other set of grooves will effect translation in the opposite direction on the guide rods. When the guide 40 reaches one end of the rods, further rotation of the rod 36 will force the lug 58 to rotate about shaft 60 to engage the other set of grooves and commence movement of the guide 40 in the opposite direction while the crank's rotation can be continued in the same direction.

Figure 3:
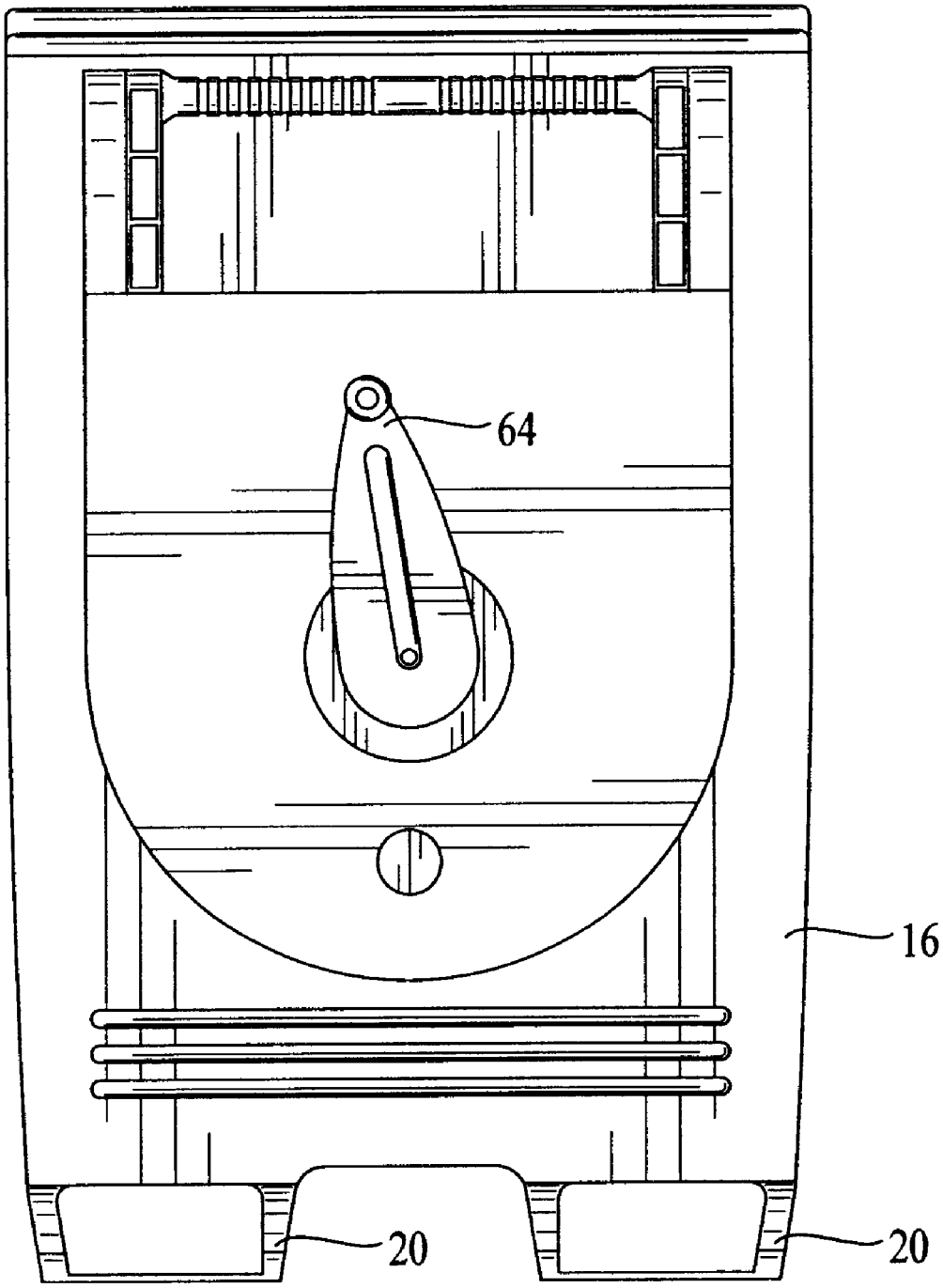
FIG. 3 is a rear view in elevation.
Figure 4:
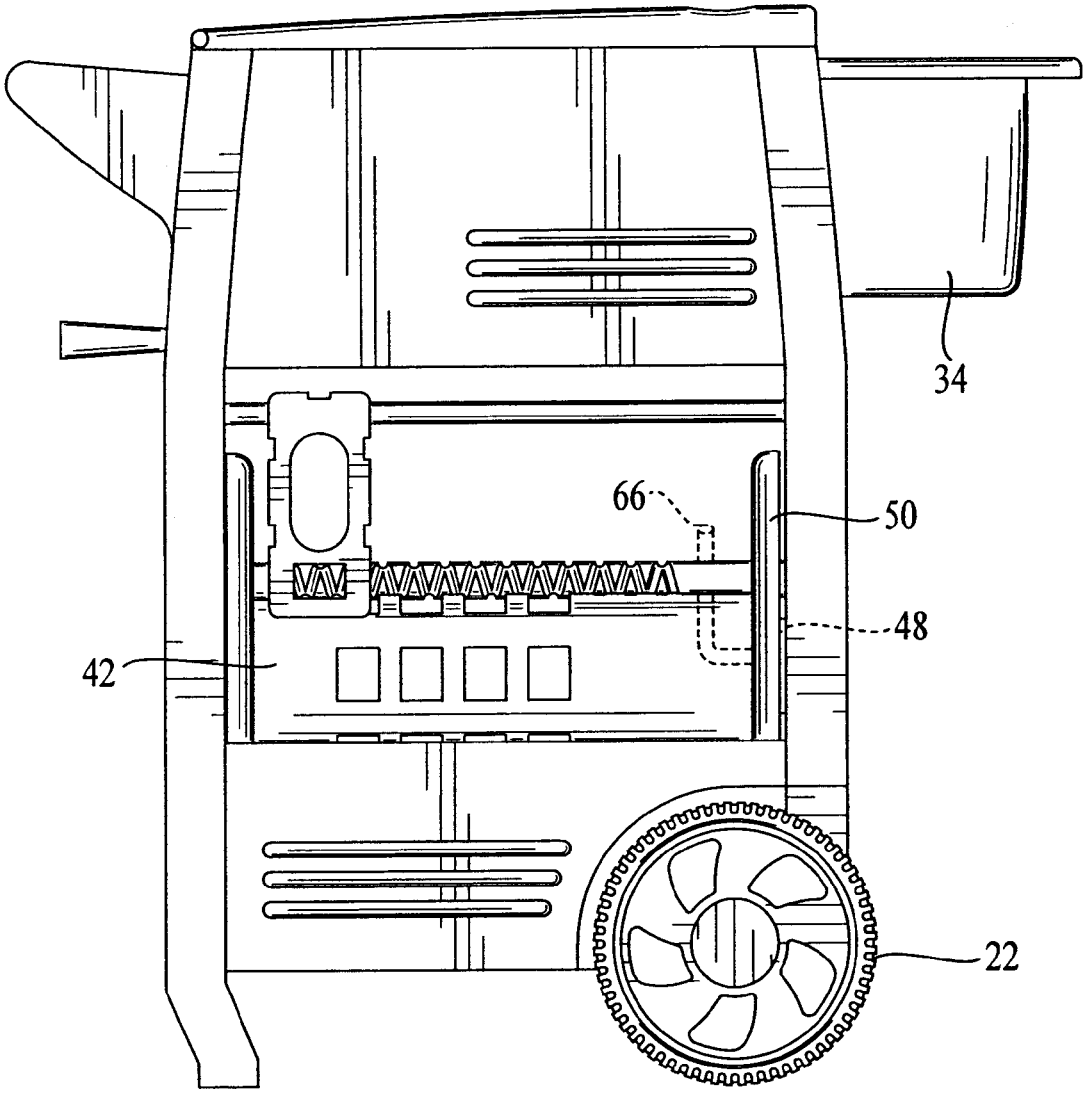
FIG. 4 is a side view opposite to the side of FIG. 2
Figure 7:
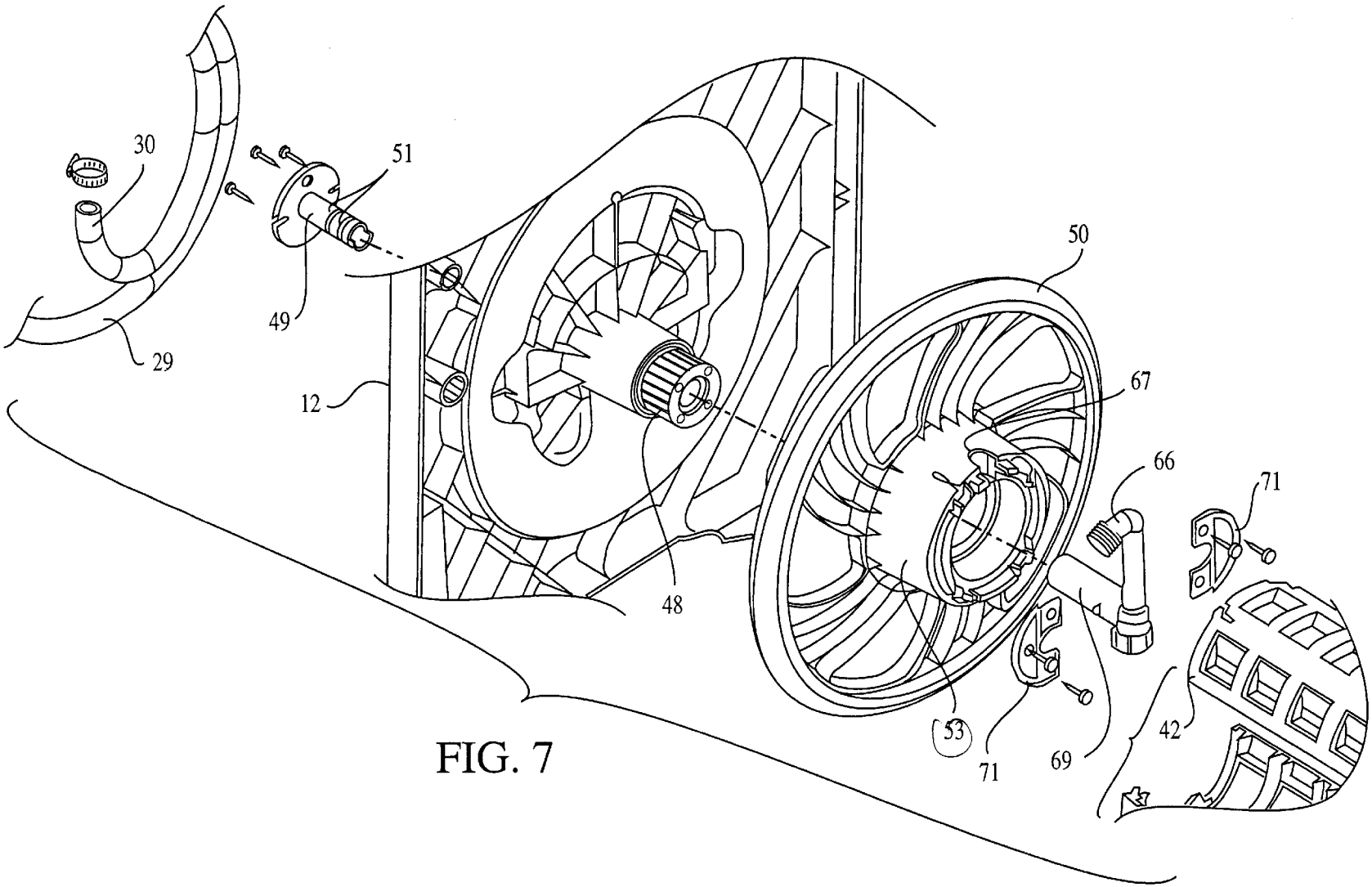
FIG. 7 is a perspective, exploded view of the reel and water connections.

With reference to FIG. 3, wall 16 is shown with the spaced apart feet 20 and the hand crank 64 which will be operated by a user to rotate the reel 42 when it is desired to reel in a hose which is connected to the water outlet pipe extending through the surface of the reel 42 as shown at 66 in FIG. 4. Also, as apparent from FIG. 4 and 7, the pipe 66 extends within axle 48 which is hollow and makes sealing contact with a stationary connector tube 49 located within axle 48 by means of one or more than O-rings carried about the exterior of the tube 49 preferably in grooves 51 formed about the circumference thereof adjacent the end thereof that is inserted into the end 69 of pipe 66. As shown in FIG. 7, the reel 42 and wheel 50 are radially spaced from the pipe 66 and tube 49. With the connection end 69 of the pipe 66 disposed about the tube 49, a secure sealing will be effected that allows unhindered rotation of the reel and pipe 66 carried by a slot 67 provided in the inner edge of hub 53. Retaining plates 71 are secured about end 69 and are, in turn, secured as by screws to the axle 48.

Figure 8:
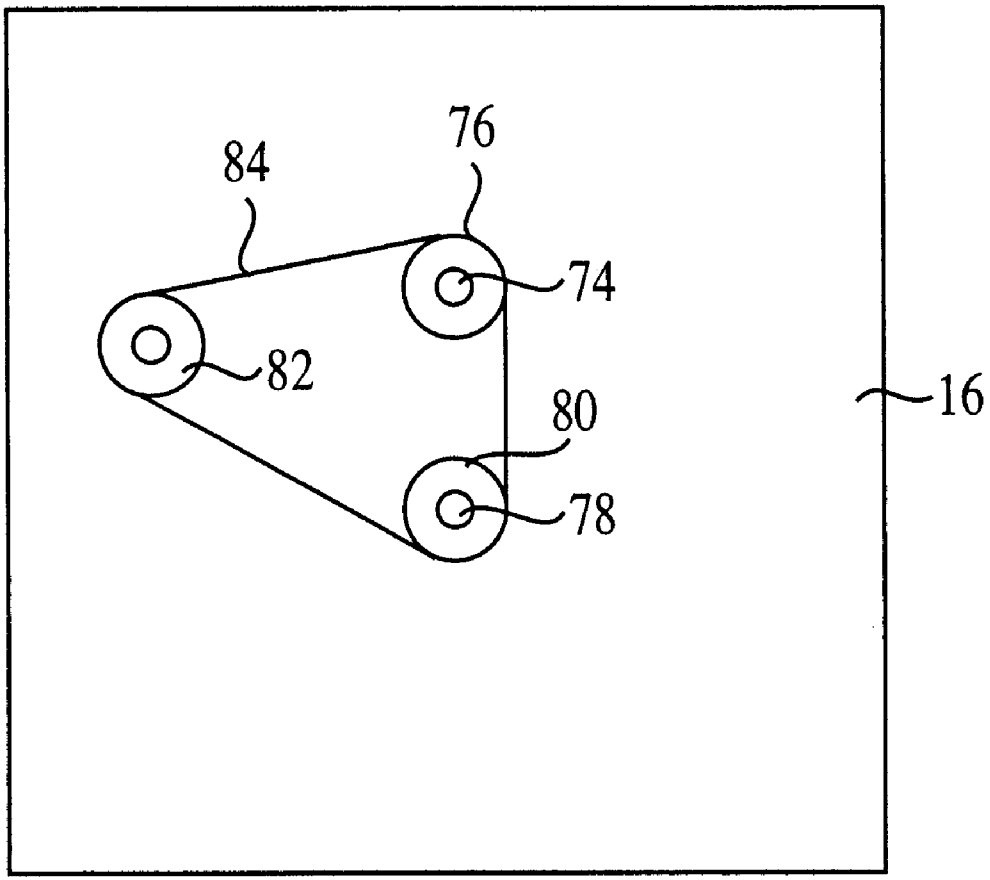
FIG. 8 is schematic illustration of the drive train for the reel and hose guide.

In operation, a user will first connect the auxiliary hose 29 to a spigot at the end 31. The other end 30 of the auxiliary hose 29 is connected to the connecting tube 49 which extends within the axle 48 where the interfitting with the connection end of the pipe 66 takes place. Since the axle 48 as shown in FIG. 7 has a larger diameter than that of tube 49 and the end of pipe 66, no stresses will be transmitted to the seal between these elements. A user will then connect one end of a hose to the opposite end of the pipe 66 that projects through the reel 42 as shown in FIGS. 4 and 7. The opening 54 in the hose guide 40 should be of a size to allow the connecting end of a hose to be inserted therethrough to facilitate this connection. When desired, the hand crank 64 will be rotated to rotate the reel 42 as well as simultaneously reciprocate the hose guide 40 along the guide rods 36 and 38 until the desired length of hose is wound on the reel 42. As shown in schematic form in FIG. 8, the hand crank 64 will have its inner end mounted on a hub 74 to which is connected a sprocket gear or wheel 76. The reel 42 will be connected to freely rotatable pinion 78 which is connected to another sprocket gear 80. Rod 36 is directly connected to a sprocket gear 82 and may be rotatably mounted the wall 16 of the carrier 10. About each of these sprocket gears or wheels 76, 80 and 82 is a sprocket chain 84. With this arrangement, rotation of the sprocket gear 76 by the hand crank 64 will directly effect rotation of the reel 42 connected to the shaft 78 with translation being transmitted through the rod 36 to the hose guide 40. It will be understood that a flexible belt may be substituted for the sprocket chain 84 although a sprocket chain tends to be more durable.

In the carrier assembly 10, above the reel 42 is a compartment for storage of gardening tools or other artifacts such as alternate nozzles of the hose. The lid 18 may be hinged along one edge. An open basket 34 may be removably suspended by hooks (not shown) from the front wall 12 adjacent the lid 18 in a manner shown in FIGS. 1–4.

To facilitate assembly as well resistance to weather conditions, the carrier 10 should be made substantially of a plastic of the type that is suitable for injection molding such as a polyvinyl carbonate, polyvinyl chloride of relatively high molecular weight.

Having described the invention, it will be apparent to those skilled in this art that various modifications may be made thereto without departing from the spirit of the invention.

What is claimed is:

1. A hose carrier for use in lawn and gardening care, said hose carrier including a pair of spaced apart side walls, a hose support member rotatably mounted between said pair of side walls, a fluid connection being carried by said support member and extending through one of said side walls, the opposite side wall having an opening, a shaft member extending from said support member through said opening in an axial direction with respect to a rotational axis of said support member and including a handle for rotating said support member, said carrier including a hose winding guide and a pair of mounting shafts extending between said side walls and on which said winding guide is carried with a first one of said shafts extending through a receiving channel in one portion of said winding guide and a second one of said shafts extending through a transmission channel in another portion of said winding guide, said opposite side wall also supporting a transmission transmitting rotary motion of said handle to said second one of said shafts, said second one of said shafts including at least one tracking groove and said winding guide including a follower member engaging said at least one tracking groove in said second one of said shafts, wherein, upon rotation of said handle, said winding guide will traverse said shaft by movement transmitted by said tracking groove through said follower member to said winding guide.

2. The invention as claimed in claim 1 wherein said support member is a cylindrically shaped body having end walls, said body having a hollow interior.

3. The invention as claimed in claim 2 wherein said cylindrically shaped body includes a peripheral surface having an opening, a fluid conduit having one end extending through said opening and an opposite end extending through a said end wall and being slidingly connected to a conduit extending through said one of side walls.

4. The invention as claimed in claim 3 wherein said conduit is connected to a length of hose and said one of said side walls is formed with a recess for allowing storage of said length of hose, said recess including a post about which said length of hose can be wrapped.

5. The invention as claimed in claim 4 wherein said post includes fluid joint associated with said fluid conduit to allow relative rotation between said fluid conduit and said length of hose.

6. The invention as claimed in claim 1 wherein said second one of said shafts includes two tracking grooves each defining a spiral path from one end of said second shaft to the opposite end thereof with one of said tracking grooves corresponding to movement in one direction on said shafts by said winding guide and the other of said tracking grooves corresponding to movement in a direction opposite to said one direction.

7. The invention as claimed in claim 1 wherein said follower member comprises a reversing lug carried in a recess provided in said winding guide and including a projecting end for engaging a said tracking groove.

8. The invention as claimed in claim 7 wherein said recess includes a spring for urging said projecting end outwardly of said recess in said winding guide.

9. The invention as claimed in claim 1 wherein said transmission includes a plurality of pulleys rotatably mounted on said opposite side wall and a flexible belt connected to said pulleys, one of said plurality of pulleys being connected to said handle.

10. The invention as claimed in claim 9 wherein another of said pulleys is connected to said second one of said shafts.

11. The invention as claimed in claim 10 wherein a further one of said pulleys is an idler pulley.

12. The invention as claimed in claim 1 wherein said carrier is provided with two ground engaging wheel members.

13. The invention as claimed in claim 1 wherein said carrier is provided with a receptacle between said side walls and a lid for said receptacle.

14. The invention as claimed in claim 1 wherein said winding guide includes an opening between said channels through which a hose may be passed.

15. The invention as claimed in claim 1 wherein said carrier includes a top and a hand grip adjacent the top thereof, said hand grip being located on said opposite side wall of said carrier.

16. A hose carrier for use in lawn and gardening care, said hose carrier including a pair of spaced apart side walls, a hose support member rotatably mounted between said pair of side walls, one of said side walls having an opening, a shaft member extending from said support member through said opening in an axial direction with respect to a rotational axis of said support member and including a handle for rotating said support member, said carrier including a hose winding guide and a support shaft arrangement extending between said side walls and on which said winding guide is carried, said one side wall also supporting a transmission transmitting rotary motion of said handle to said support shaft arrangement, said support shaft arrangement including at least one tracking groove and said winding guide including a follower member engaging said at least one tracking groove, wherein, upon rotation of said handle, said winding guide will traverse said support shaft arrangement by movement transmitted by said tracking groove through said follower member to said winding guide.

17. The invention as claimed in claim 16 wherein said support member is a cylindrically shaped body having end walls, said body having a hollow interior.

18. The invention as claimed in claim 17 wherein said cylindrically shaped body includes a peripheral surface having an opening, a fluid conduit having one end extending through said opening and an opposite end extending through a said end wall and being slidingly connected to a conduit extending through said one of side walls.

19. The invention as claimed in claim 18 wherein said conduit is connected to a length of hose and said one of said side walls is formed with a recess for allowing storage of said length of hose, said recess including a post about which said length of hose can be wrapped.

20. The invention as claimed in claim 19 wherein said post includes fluid joint associated with said fluid conduit to allow relative rotation between said fluid conduit and said length of hose.

21. The invention as claimed in claim 16 wherein said second one of said shafts includes two tracking grooves each defining a spiral path from one end of said second shaft to the opposite end thereof with one of said tracking grooves corresponding to movement in one direction on said shafts by said winding guide and the other of said tracking grooves corresponding to movement in a direction opposite to said one direction.

22. The invention as claimed in claim 16 wherein said follower member comprises a reversing lug carried in a recess provided in said winding guide and including a projecting end for engaging a said tracking groove.

23. The invention as claimed in claim 22 wherein said recess includes a spring for urging said projecting end outwardly of said recess in said winding guide.

24. The invention as claimed in claim 16 wherein said transmission includes a plurality of pulleys rotatably mounted on said opposite side wall and a flexible belt connected to said pulleys, one of said plurality of pulleys being connected to said handle.

25. The invention as claimed in claim 24 wherein another of said pulleys is connected to said second one of said shafts.

26. The invention as claimed in claim 25 wherein a further one of said pulleys is an idler pulley.

27. The invention as claimed in claim 16 wherein said carrier is provided with two ground engaging wheel members.

28. The invention as claimed in claim 16 wherein said carrier is provided with a receptacle between said side walls and a lid for said receptacle.

29. The invention as claimed in claim 16 wherein said winding guide includes an opening between said channels through which a hose may be passed.

30. The invention as claimed in claim 1 wherein said carrier includes a top and a hand grip adjacent the top thereof, said hand grip being located on said opposite side wall of said carrier.

31. A hose carrier for use in lawn and gardening care, said hose carrier including a pair of spaced apart side walls, a hose support member rotatably mounted between said pair of side walls, one of said side walls having an opening, a shaft member extending from said support member through said opening in an axial direction with respect to a rotational axis of said support member and including a handle for rotating said support member, said carrier including a hose winding guide and a support shaft arrangement extending between said side walls and on which said winding guide is carried, said one side wall also supporting a transmission transmitting rotary motion of said handle to said support shaft arrangement, said support shaft arrangement including a first and a second tracking groove and said winding guide including a follower member engaging said one of said first and second tracking grooves, said follower member being shiftable on said winding guide so that, upon rotation of said handle, said winding guide will traverse said support shaft arrangement by movement transmitted through said follower member engaging one of said first and second tracking grooves, until said support shaft arrangement is fully traversed by said winding guide.

32. A hose carrier assembly for use in gardening and lawn care comprising:

a carrier body having a lower end including a leading edge and wheel structure rotatably mounted adjacent said leading edge, an upper end having a trailing edge and handle structure for use by an operator to grasp and move said carrier body over the ground, a first side face and a second opposite side face with said first side face including storage structure for a hose and a hose inlet conduit, an interior space located between said first and second side faces, a hose reel rotatably mounted in said interior space, means for rotating said reel extending through said second side face and terminating in a handle for use by an operator.

33. The invention as claimed in claim 32 further including a storage compartment for lawn and garden tools and extending over said interior space between said first and second side faces.

34. The invention as claimed in claim 32 further including a movable guide member for guiding a hose as the hose is fed to or from said reel.

35. The invention as claimed in claim 34 wherein said movable guide member is mounted for reciprocating movement on guide rods extending between said first and second faces.

36. The invention as claimed in claim 35 wherein one of said guide rods is provided with guide grooves and said guide member includes a shiftable boss for engaging in one of said guide grooves during one reciprocation of said guide member.

37. The invention as claimed in claim 36 wherein said one of said guide rods has a longitudinal axis and is mounted for rotation about said longitudinal axis, said one of said guide rods being linked to said reel so that, upon rotation of said reel, rotation of said one of said guide rods will be effected.

38. The invention as claimed in claim 1 wherein said one of said side walls includes an article bin supported thereon.

39. A hose reel apparatus for use in lawn and gardening care for winding and dispensing a length of hose, said hose reel apparatus comprising:

a frame comprising downwardly facing ground engaging surfaces and at least a pair of opposing side walls that extend generally vertically when said ground engaging surfaces are engaged with the ground;

a hose reel rotatably mounted between said side walls for rotation about a hose reel axis, said hose reel axis extending in a transverse direction between said side walls and generally horizontally when said ground engaging surfaces are engaged with the ground, said hose reel providing a hose engaging surface configured to enable a length of hose to be wound thereon by rotation of said hose reel about said transversely extending hose reel axis in a winding direction and to enable said hose reel to be rotated in an opposite unwinding direction about said transversely extending hose reel axis for unwinding the length of hose therefrom;

a fixed inlet connection member carried on said frame for connection to a water supply and a movable outlet connection member carried on said hose reel for connection to a proximal end of the hose when wound on said hose reel, said fixed inlet connection member being fluidly connected to said movable outlet connection member such that water from said water supply can be delivered to and through the hose;

a winding handle rotatably mounted adjacent one of said side walls exteriorly thereof for rotation about a handle axis extending in said transverse direction and generally horizontally when said ground engaging surfaces are engaged with the ground, said winding handle manually rotatable about said transversely extending handle axis to rotate said hose reel in said winding direction about said transversely extending hose reel axis;

a hose guide having an opening therethrough for receiving an unwound portion of the length of hose therethrough;

a hose guide mounting structure extending in said transverse direction between said side walls, said hose guide being mounted on said hose guide mounting structure in spaced apart relation from said hose engaging surface for movement along said hose guide mounting structure in said transverse direction to move the unwound portion of the length of hose transversely during said winding and said unwinding so that the hose is wound onto and unwound from said hose engaging surface in an evenly distributed manner with respect to said transverse direction;

said hose guide mounting structure comprising a transmission shaft having a tracking groove formed therein and being rotatable about a transmission shaft axis extending in said transverse direction and generally horizontally when said ground engaging surfaces are engaged with the ground, said transversely extending transmission shaft axis being parallel to and in spaced relation from said transversely extending handle axis and said transversely extending hose reel axis;

said hose guide including a follower element received in said tracking groove, said tracking groove being configured and arranged such that rotation of said transmission shaft about said transversely extending transmission shaft axis causes said follower element to travel along said groove so that said hose guide is moved in a reversing reciprocating manner in said transverse direction along said hose guide mounting structure;

a transmission carried on said one of said side walls, said transmission being operatively connected to said transmission shaft and being constructed and arranged such that (a) rotation of said handle about said transversely extending handle axis to rotate said hose reel in said winding direction about said transversely extending hose reel axis simultaneously rotates said transmission shaft about said transversely extending transmission shaft axis so that said hose guide guides the unwound portion of the hose onto said hose engaging surface of said hose reel in said unevenly distributed manner with respect to said transverse direction and (b) said transmission shaft rotates about said transversely extending transmission shaft axis simultaneously with rotation of said hose reel about said transversely extending hose reel axis in said unwinding direction during unwinding of said hose so that said hose guide guides the unwound portion of the hose to unwind the length of hose in said evenly distributed manner with respect to said transverse direction.

40. A hose reel apparatus according to claim 39, wherein said handle axis is spaced radically from said handle axis.

41. A hose reel apparatus according to claim 40, wherein said transmission includes a circular transmission member rotatable with said transmission shaft, a circular transmission member rotatable with said hose reel, and a circular transmission member rotatable with said handle.

42. A hose reel apparatus according to claim 41, wherein said circular transmission members are each toothed gears.

43. A hose reel apparatus according to claim 42, wherein said transmission includes a flexible element wound about said toothed gears so as to simultaneously transmit rotation therebetween.

44. A hose reel apparatus according to claim 43, wherein said flexible element is a sprocket chain.

45. A hose reel apparatus according to claim 41, wherein said transmission includes a flexible element wound about said circular transmission members so as to simultaneously transmit rotation therebetween.

46. A hose reel apparatus according to claim 45, wherein said flexible element is selected from the group consisting of a sprocket chain and a belt.

47. A hose reel apparatus according to claim 42, wherein said handle, said frame and the side walls thereof, said hose reel, said toothed gears, said hose guide, and said transmission shaft are each molded from plastic.

48. A hose reel apparatus according to claim 39, wherein said hose reel mounting structure further comprises a fixed shaft mounted in spaced apart relation from said transmission shaft, said hose guide being mounted on said fixed shaft for sliding movement therealong in said transverse direction and said fixed shaft and said transmission shaft cooperating to prevent rotation of said hose guide.

49. A hose reel apparatus according to claim 47, wherein said hose guide has a first opening extending therethrough in which said fixed shaft is received and a second opening extending therethrough in which said transmission shaft is received, said follower element extending into said second opening for engagement with said tracking groove.

50. A hose reel apparatus according to claim 49, wherein said transmission and said fixed shafts are spaced apart vertically.

51. A hose reel apparatus according to claim 39, wherein said follower element is a shiftable lug and said hose guide includes a spring biasing said lug into engagement with said tracking groove.

52. A hose reel apparatus according to claim 39, wherein said tracking groove is defined by a pair of spiral grooves formed in counterspiraling relation with respect to one another along said transmission shaft, said grooves being communicated at each opposing end thereof to provide for reversal of said hose guide as it moves therealong in said reversing reciprocating manner during winding and unwinding of the hose.

53. A hose reel apparatus according to claim 39, wherein said handle include an inner portion extending through said one of said side walls, a lever portion extending generally radially with respect to said handle axis from said inner portion, and a hand grip portion extending generally parallel to said handle axis from said lever portion and away from said one of said side walls.

54. A hose reel apparatus according to claim 39, wherein said frame further comprises a pair of wheels rotatably mounted thereto for enabling said hose reel apparatus to be rollingly transported, said ground engaging surfaces including surfaces of said wheels.

55. A hose reel apparatus according to claim 54, further comprising a transport handle mounted to an upper portion of said frame for facilitating rolling transport of said hose reel apparatus.

56. A hose reel apparatus for use in lawn and gardening care for winding and dispensing a length of hose, said hose reel apparatus comprising:

a frame comprising downwardly facing ground engaging surfaces and at least a pair of opposing side walls that extend generally vertically when said ground engaging surfaces are engaged with the ground;

a hose reel rotatably mounted between said side walls for rotation about a hose reel axis, said hose reel axis extending in a transverse direction between said side walls and generally horizontally when said ground engaging surfaces are engaged with the ground, said hose reel providing a hose engaging surface configured to enable a length of dispensable hose to be wound thereon by rotation of said hose reel about said hose reel axis in a winding direction and to enable said hose reel to be rotated in an opposite unwinding direction for unwinding the length of dispensable hose therefrom;

a leader hose having a free end fluidly connectable to a water supply;

a fixed inlet connection member carried on one of said side walls of said frame and having an opposite end of said leader hose fluidly connected thereto;

a leader hose storage structure provided on an exterior surface of said one of said side walls of said frame adjacent said fixed inlet connection member, said leader hose storage structure being constructed and arranged to enable said leader hose to be wound therearound in a stored position and providing structure positioned in spaced apart from said one of said side walls to define a space for receiving said leader hose therein when said leader hose in wound in said stored position to thereby retain said leader hose on said storage structure;

a movable outlet connection member carried on said hose reel for rotation therewith and for connection to a proximal end of the dispensable hose when wound on said hose reel, said fixed inlet connection member being fluidly connected to said movable outlet connection member such that water from said water supply can be delivered to and through said dispensable hose via said leader hose.

57. A hose reel apparatus according to claim 56, wherein said one of said side walls has a storage recess defined on the exterior surface thereof, said storage structure being positioned within said storage recess.

58. A hose reel apparatus according to claim 57, wherein said storage structure extends outwardly from said one of said side walls and wherein said structure defining said space is provided by a plurality of wings extending radially therefrom towards a periphery of said recess.

59. A hose reel apparatus according to claim 56, wherein said storage structure extends outwardly from said one of said side walls and wherein said structure defining said space is provided by a plurality of wings extending radially therefrom.

60. A hose reel apparatus according to claim 56, further comprising a winding handle rotatably mounted adjacent one of said side walls exteriorly thereof for rotation about a handle axis extending in said transverse direction and generally horizontally when said ground engaging surfaces are engaged with the ground, said winding handle being manually rotatable about said handle axis to rotate said hose reel in said winding direction about said hose reel axis.

61. A hose reel apparatus according to claim 60, further comprising:

a hose guide having an opening therethrough for receiving an unwound portion of the length of hose therethorugh;

a hose guide mounting structure extending in said transverse direction between said side walls, said hose guide being mounted on said hose guide mounting structure in spaced apart relation from said hose engaging surface for movement along said hose guide mounting structure in said transverse direction to move the unwound portion of the length of hose transversely during said winding and said unwinding so that the hose is wound onto and unwound from said hose engaging surface in an evenly distributed manner with respect to said transverse direction;

said hose guide mounting structure comprising a transmission shaft having a tracking groove formed therein and being rotatable about a transmission shaft axis extending in said transverse direction and generally horizontally when said ground engaging surfaces are engaged with the ground, said transversely extending transmission shaft axis being parallel to and in spaced relation from said transversely extending handle axis and said transversely extending hose reel axis;

said hose guide including a follower element received in said tracking groove, said tracking groove being configured and arranged such that rotation of said transmission shaft about said transversely extending transmission shaft axis causes said follower element to travel along said groove so that said hose guide is moved in a reversing reciprocating manner in said transverse direction along said hose guide mounting structure;

a transmission carried on said one of said side walls, said transmission being operatively connected to said transmission shaft and being constructed and arranged such that (a) rotation of said handle about said transversely extending handle axis to rotate said hose reel in said winding direction about said transversely extending hose reel axis simultaneously rotates said transmission shaft about said transversely extending transmission shaft axis so that said hose guide guides the unwound portion of the hose onto said hose engaging surface of said hose reel in said evenly distributed manner with respect to said transverse direction and (b) said transmission shaft rotates about said transversely extending transmission shaft axis simultaneously with rotation of said hose reel about said transversely extending hose reel axis in said unwinding direction during unwinding of said hope so that said hope guide guides the unwound portion of the hose to unwind the length of those in said evenly distributed manner with respect to said transverse direction.

62. A hose reel apparatus according to claim 61, wherein said follower element is a shiftable lug and said hose guide includes a spring biasing said lug into engagement with said tracking groove.

63. A hose reel apparatus according to claim 61, wherein said tracking groove is defined by a pair of spiral grooves formed in counterspiraling relation with respect to one another along said transmission shaft, said grooves being communicated at each opposing end thereof to provide for reversal of said hose guide as it moves therealong in said reversing reciprocating manner during winding and unwinding of the hose.

64. A hose reel apparatus according to claim 61, wherein said handle include an inner portion extending through said one of said side walls, a lever portion extending generally radially with respect to said handle axis from said inner portion, and a hand grip portion extending generally parallel to said handle axis from said lever portion and away from said one of said side walls.

65. A hose reel apparatus according to claim 71, wherein said frame further comprises a pair of wheels rotatably mounted thereto for enabling said hose reel apparatus to be rollingly transported, said ground engaging surfaces including surfaces of said wheels.

66. A hose reel apparatus according to claim 65, further comprising a transport handle mounted to an upper portion of said frame for facilitating rolling transport of said hose reel apparatus.

67. A hose reel apparatus according to claim 60, wherein said handle axis is spaced radially from said hose reel axis.

68. A hose reel apparatus according to claim 67, wherein said transmission includes a circular transmission member rotatable with said transmission shaft, a circular transmission member rotatable with said hose reel, and a circular transmission member rotatable with said handle.

69. A hose reel apparatus according to claim 68, wherein said transmission includes a flexible element wound about said circular transmission members so as to simultaneously transmit rotation therebetween.

70. A hose reel apparatus according to claim 69, wherein said flexible element is selected from the group consisting of a sprocket chain and a belt.

71. A hose reel apparatus according to claim 68, wherein said circular transmission members are each toothed gears.

72. A hose reel apparatus according to claim 71, wherein said transmission includes a flexible element wound about said toothed gears so as to simultaneously transmit rotation therebetween.

73. A hose reel apparatus according to claim 72, wherein said flexible element is a sprocket chain.

74. A hose reel apparatus according to claim 71, wherein said handle, said frame and the side walls thereof, said hose reel, said toothed gears, said hose guide, and said transmission shaft are each molded from plastic.

75. A hose reel apparatus according to claim 61, wherein said hose reel mounting structure further comprises a fixed shaft mounted in spaced apart relation from said transmission shaft, said hose guide being mounted on said fixed shaft for sliding movement therealong in said transverse direction and said fixed shaft and said transmission shaft cooperating to prevent rotation of said hose guide.

76. A hose reel apparatus according to claim 75, wherein said hose guide has a first opening extending therethough in which said fixed shaft is received and a second opening extending therethough in which said transmission shaft is received, said follower element extending into said second opening for engagement with said tracking groove.

77. A hose reel apparatus according to claim 76, wherein said transmission and said fixed shafts are spaced apart vertically.

78. A hose reel apparatus for use in lawn and gardening care for winding and dispensing a length of hose, said hose reel apparatus comprising:

a molded plastic frame comprising downwardly facing ground engaging surfaces and at least a pair of opposing side walls that extend generally vertically when said ground engaging surfaces are engaged with the ground;

a molded plastic hose reel rotatably mounted between said side walls for rotation about a hose reel axis, said hose reel axis extending in a transverse direction between said side walls and generally horizontally when said ground engaging surfaces are engaged with the ground, said hose reel providing a hose engaging surface configured to enable a length of hose to be wound thereon by rotation of said hose reel about said transversely extending hose reel axis in a winding direction and to enable said hose reel to be rotated in an opposite unwinding direction about said transversely extending hose reel axis for unwinding the length of hose therefrom;

a fixed inlet connection member carried on said frame for connection to a water supply and a movable outlet connection member carried on said hose reel for the connection to a proximal end of the hose when wound on said hose reel, said fixed inlet connection member being fluidly connected to said movable outlet connection member such that water from said water supply can be delivered to and through the hose a molded plastic winding handle rotatably mounted adjacent one of said side walls exteriorly thereof for rotation about a handle axis, and handle axis extending in said transverse direction and generally horizontally when said ground engaging surfaces are engaged with the ground, said handle axis being spaced radially from said hose reel axis, said winding handle being manually rotatable about said transversely extending handle axis to rotate said hose reel in said winding direction about said transversely extending hose reel axis;

a molded plastic hose guide having an opening therethrough for receiving an unwound portion of the length of hose therethrough;

a hose guide mounting structure extending in said transverse direction between said side walls, said hose guide being mounted on said hose guide mounting structure in spaced apart relation from said hose engaging surface for movement along said hose guide mounting structure in said transverse direction to move the unwound portion of the length of hose transversely during said winding and said unwinding so that the hose is wound onto and unwound from said hose engaging surface in an evenly distributed manner with respect to said transverse direction;

said hose guide mounting structure comprising (a) a molded plastic transmission shaft having a tracking groove formed therein and being rotatable about a transmission shaft axis extending in said transverse direction and generally horizontally when said ground engaging surfaces are engaged with the ground and (b) a molded plastic fixed shaft spaced apart from said transmission shaft, said transversely extending transmission shaft axis being parallel to and in spaced relation from said transversely extending handle axis and said transversely extending hose reel axis;

said hose guide being mounted on said fixed shaft and said transmission shaft for movement therealong in said transverse direction with said fixed shaft and said transmission shaft cooperating to prevent rotation of said hose guide, said hose guide including a follower element received in said tracking groove, said tracking groove being configured and arranged such that rotation of said transmission shaft about said transversely extending transmission shaft axis causes said follower element to travel along said groove so that said hose guide is moved in a reversing reciprocating manner in said transverse direction along said fixed shaft and said transmission shaft;

a transmission carried on said one of said side walls and including a molded plastic toothed gear rotatable with said handle, a molded plastic toothed gear rotatable with said hose reel and a molded plastic toothed gear rotatable with said transmission shaft, said toothed gears enabling (a) rotation of said handle about said transversely extending handle axis to rotate said hose reel in said winding direction about said transversely extending hose reel axis simultaneously rotates said transmission shaft about said transversely extending transmission shaft axis so that said hose guide guides the unwound portion of the hose onto said hose engaging surface of said hose reel in said unevenly distributed manner with respect to said transverse direction and (b) said transmission shaft rotates about said transversely extending transmission shaft axis simultaneously with rotation of said hose reel about said transversely extending hose reel axis in said unwinding direction during unwinding of said hose so that said hose guides the unwound portion of the hose to unwind the length of hose in said evenly distributed manner with respect to said transverse direction.

* * * * *

UNITED STATES PATENT AND TRADEMARK OFFICE

CERTIFICATE OF CORRECTION

PATENT NO. : 6,338,360 B2
DATED : January 15, 2002
INVENTOR(S) : Spear et al.

It is certified that error appears in the above-identified patent and that said Letters Patent is hereby corrected as shown below:

Column 8,
Line 65, should read -- 40. A hose reel apparatus according to claim 39, wherein said handle axis is spaced radially from said hose reel axis.

Column 10,
Line 27, after "apart" insert -- relation --; and
Line 29, change "in" to -- is --. (1st occurrence)

Signed and Sealed this

Twenty-sixth Day of November, 2002

*Attest:*

*Attesting Officer*

JAMES E. ROGAN
*Director of the United States Patent and Trademark Office*